US007744429B2

(12) United States Patent
Zhang et al.

(10) Patent No.: US 7,744,429 B2
(45) Date of Patent: Jun. 29, 2010

(54) CONNECTOR WITH PLUGGING DIRECTION PERPENDICULAR TO CIRCUIT BOARDS

(75) Inventors: Zhong-Ming Zhang, Taoyuan Hsien (TW); Yun Zuo, Taoyuan Hsien (TW); Yu-Yuan Tai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/142,349

(22) Filed: Jun. 19, 2008

(65) Prior Publication Data

US 2009/0170355 A1 Jul. 2, 2009

(30) Foreign Application Priority Data

Dec. 26, 2007 (TW) ..... 96150230 A

(51) Int. Cl.
*H01R 24/00* (2006.01)

(52) U.S. Cl. ..... 439/676; 439/620.11

(58) Field of Classification Search ..... 439/676, 439/620.11, 620.17, 620.21, 620.23
See application file for complete search history.

(56) References Cited

U.S. PATENT DOCUMENTS 5,312,273 A * 5/1994 Andre et al. ..... 439/607
5,378,172 A * 1/1995 Roberts ..... 439/607.26
5,626,497 A * 5/1997 Bouchan et al. ..... 439/676
5,766,043 A * 6/1998 Talend ..... 439/676
6,012,936 A * 1/2000 Siemon et al. ..... 439/188
6,431,917 B1 * 8/2002 Belopolsky et al. ..... 439/676
6,450,838 B2 * 9/2002 Arnett ..... 439/676
6,537,110 B1 * 3/2003 Korsunsky et al. ..... 439/676
6,623,306 B2 * 9/2003 Xu et al. ..... 439/676
6,695,649 B1 * 2/2004 Ciezak et al. ..... 439/676
6,786,772 B1 * 9/2004 Liu ..... 439/620.06
7,121,898 B2 * 10/2006 Murr et al. ..... 439/676
7,153,158 B1 * 12/2006 Lee ..... 439/541.5
7,341,492 B2 * 3/2008 Wang et al. ..... 439/676
7,351,106 B2 * 4/2008 Zhu et al. ..... 439/607.27
2005/0142952 A1 * 6/2005 Peng ..... 439/676
2006/0128228 A1 * 6/2006 Wan et al. ..... 439/676
2007/0059988 A1 * 3/2007 Bolouri-Saransar ..... 439/676
2008/0233803 A1 * 9/2008 Renteria et al. ..... 439/620.15

* cited by examiner

*Primary Examiner*—Hae Moon Hyeon
(74) *Attorney, Agent, or Firm*—Muncy, Geissler, Olds & Lowe, PLLC

(57) ABSTRACT

A connector connected with a circuit board includes a housing and a main body. The housing has an insert hole and an accommodating portion. The main body is fixed in the accommodating portion and has a plurality of signal terminals and a plurality of pins arranged in the same direction. When a plug is plugged in the insert hole, a plugging direction of the plug is perpendicular to the circuit board.

16 Claims, 5 Drawing Sheets

CONNECTOR WITH PLUGGING DIRECTION PERPENDICULAR TO CIRCUIT BOARDS

CROSS REFERENCE TO RELATED APPLICATIONS

This Non-provisional application claims priority under 35 U.S.C. §119(a) on Patent Application No(s). 096150230 filed in Taiwan, Republic of China on Dec. 26, 2007, the entire contents of which are hereby incorporated by reference.

BACKGROUND OF THE INVENTION

1. Field of Invention

The present invention relates to a connector and, in particular, to a connector for communicating transmission.

2. Related Art

Accompanying with the development of electronic technology and communication technology, the present electronic products usually have the communicating transmission function. Generally speaking, the communicating transmission function can be carried out by a connector and a plug.

Referring to FIG. 1, a conventional connector for data transmission through network includes a housing 11 and a plurality of signal pins 12. The housing 11 has an insert hole O, and the signal pins 12 are disposed in the insert hole O. The insert hole O is connected with a plug P such as an RJ-45 plug to transmit data through network.

To connect the plug P with the connector 1, the plug P is plugged into the insert hole O of the housing 11 along a horizontal direction H. Then, the plug P can be electrically connected with the signal pins 12 of the connector 1 so as to transmit data through network.

However, because the connector 1 has a large bottom size, it will occupy a certain area of a circuit board, thereby influencing the layout of the circuit board and thus limiting the space for allocating other circuitries on the circuit board.

SUMMARY OF THE INVENTION

In view of the foregoing, the present invention is to provide a connector having a pin direction the same as a plugging direction of an associated plug such that the plug can be plugged in the connector in a direction perpendicular to a circuit board. Accordingly, the layout for the connector can be reduced, and the circuit layout of the circuit board can be more flexible.

To achieve the above, a connector connected with a circuit board according to the present invention includes a housing and a main body. The housing has an insert hole and an accommodating portion. The main body is fixed in the accommodating portion and has a plurality of signal terminals and a plurality of pins arranged in the same direction. When a plug is plugged in the insert hole, a plugging direction of the plug is perpendicular to the circuit board.

As mentioned above, in the connector according to the present invention, the guiding portion and the fixing portion are respectively disposed at the inner circumference of the housing and the outer circumference of the main body, and the arranging directions of the signal terminals and pins can be changed so that the plugging direction of the plug is concordant as the direction of the pins and is perpendicular to the circuit board. Compared with the prior art, a plug can be plugged in the connector of the present invention in a direction perpendicular to the circuit board. Therefore, the present invention can not only change the plugging direction of the plug, but also decrease the layout of the circuit board for the connector so as to improve the circuit layout flexibility. In addition, the present invention also increases the variation of disposing direction of the circuit board in the electronic device, and increases utilization of space design in the electronic device.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
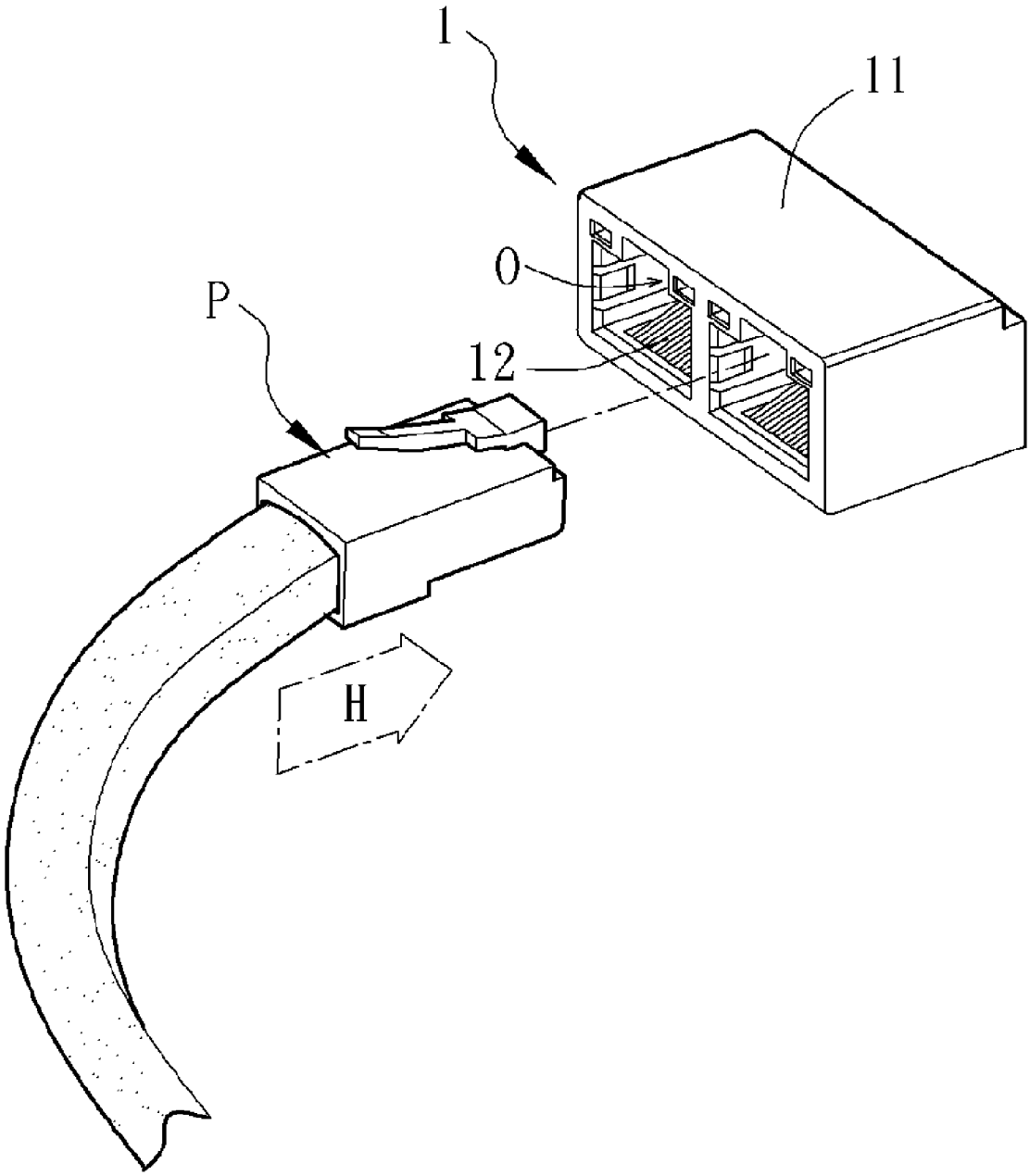
FIG. 1 (PRIOR ART)
FIG. 1 is a schematic diagram showing the conventional connector connected with a plug.
Figure 2:
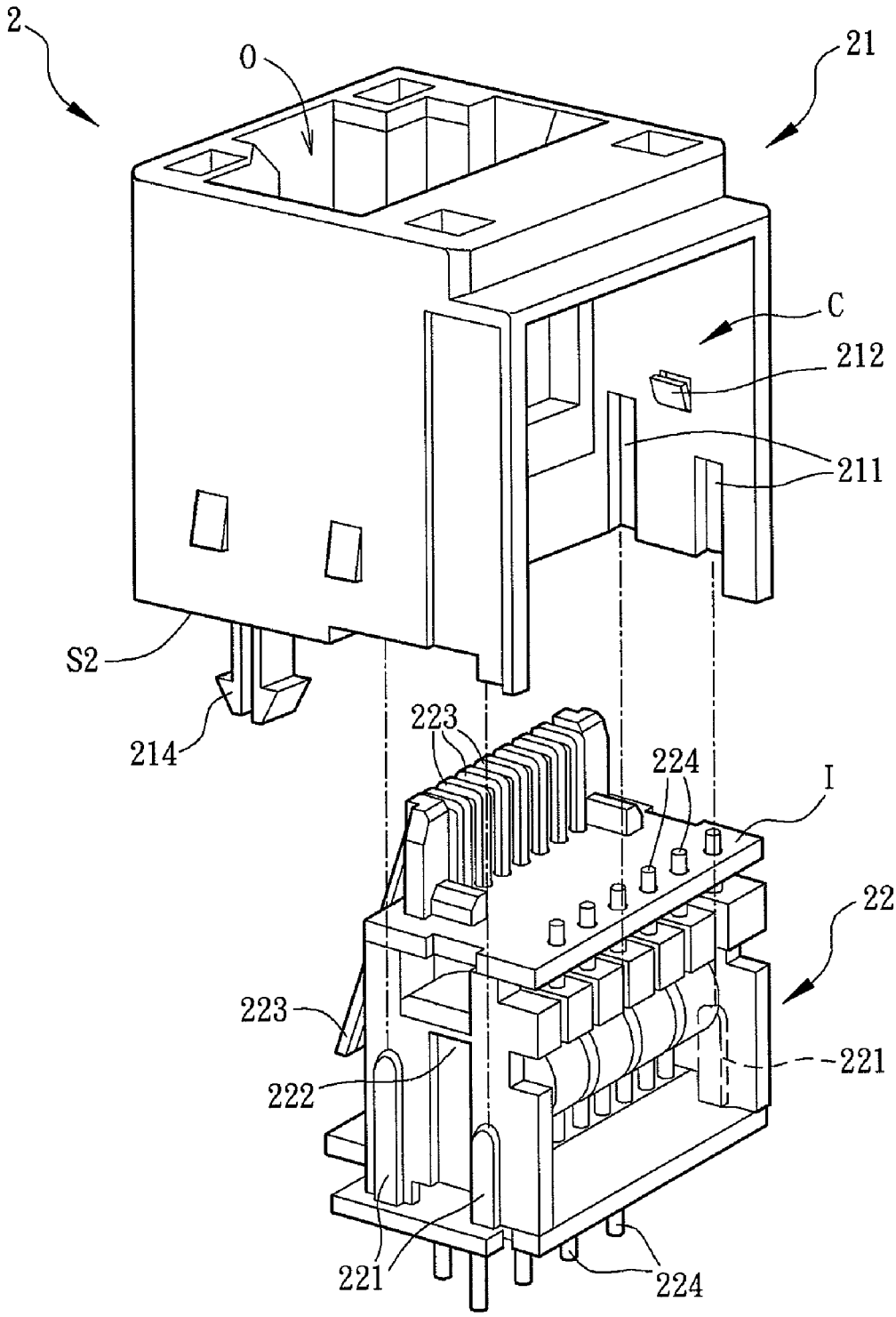
FIG. 2 is a schematic diagram showing a housing and a main body of a connector according to an embodiment of the present invention.

Referring to FIG. 2, a connector 2 according to an embodiment of the present invention includes a housing 21 and a main body 22. The connector 2 can be a network communicating connector such as an RJ-45 connector, an RJ-11 connector or an RJ-12 connector.

The housing 21 of the connector 2 is a rectangular housing and includes an insert hole O and an accommodating portion C. The housing 21 further includes at least one first guiding portion 211 and at least one first fixing portion 212 disposed at inner circumference of the accommodating portion C. The first guiding portion 211 is, for example but not limited to, a guiding slot or a guiding track. In the embodiment, the first guiding portion 211 is a guiding slot, which is integrally formed as a single piece on the inner circumference of the accommodating portion C. The first fixing portion 212 is, for example but not limited to, a protrusion, a concave, a clasp, a bulk or a groove. In the embodiment, the first fixing portion 212 is a clasp, which is integrally formed as a single piece on the inner circumference of the accommodating portion C and located above the first guiding portion 211. In addition, a bottom S2 of the housing 21 has at least one clasp 214 for fixing the connector 2 on the circuit board. Of course, the housing 21 may include two clasps which have opposite clasping directions, so that the housing 21 can sustain force homogenously so as to improve the fixing stability.

The main body 22 has a plurality of signal terminals 223, a plurality of pins 224, at least one second guiding portion 221 and at least one second fixing portion 222. The signal terminals 223 can be electrically connected with corresponding terminals of an RJ-45 connector, an RJ-11 connector, or an RJ-12 connector. In the embodiment, the pins 224 are separated from the signal terminals 223.

The second guiding portion 221 and the second fixing portion 222 are disposed on the outer circumference of the main body 22 and are located respectively corresponding to the first guiding portion 211 and the first fixing portion 212. The second guiding portion 221 is, for example but not limited to, a guiding slot or a guiding track. In the embodiment, the first guiding portion 211 is a guiding slot, and the second guiding portion 221 is correspondingly a guiding track. The second guiding portion 221 is integrally formed as a single piece on the outer circumference (two sides) of the main body 22. The second fixing portion 222 can be, for example but not limited to, a protrusion, a concave, a clasp, a bulk or a groove. In the embodiment, the second fixing portion 222 is a groove while the first fixing portion 212 is a clasp. The second fixing portion 222 is integrally formed as a single piece on the outer circumference of the main body 22 and located above the second guiding portion 221. Alternatively, except the above-mentioned combination of a concave and a clasp, the designation of the first fixing portion 212 to the second fixing portion 222 can also be a combination of a protrusion and a protrusion or a combination of two clasps.

It is noted that the signal terminals 223 and the pins 224 are preferably disposed in the same direction as the first guiding portion 211 and the second guiding portion 221. Of course, if the connector 2 has different combining configuration, the signal terminals 223 or the pins 224 can be disposed in the direction different from that of the first guiding portion 211 and the second guiding portion 221.

To assemble the housing 21 with the main body 22, the guiding slot of the first guiding portion 211 is slid along the guiding track of the second guiding portion 221, so that the housing 21 and the main body 22 can be guided to the desired positions. In the embodiment, the clasp of the first fixing portion 212 and the groove of the second fixing portion 222 are successfully fixed and assembled, thereby achieving the goals of positioning and preventing from loosing of the housing 21 and the main body 22.

Figure 3:
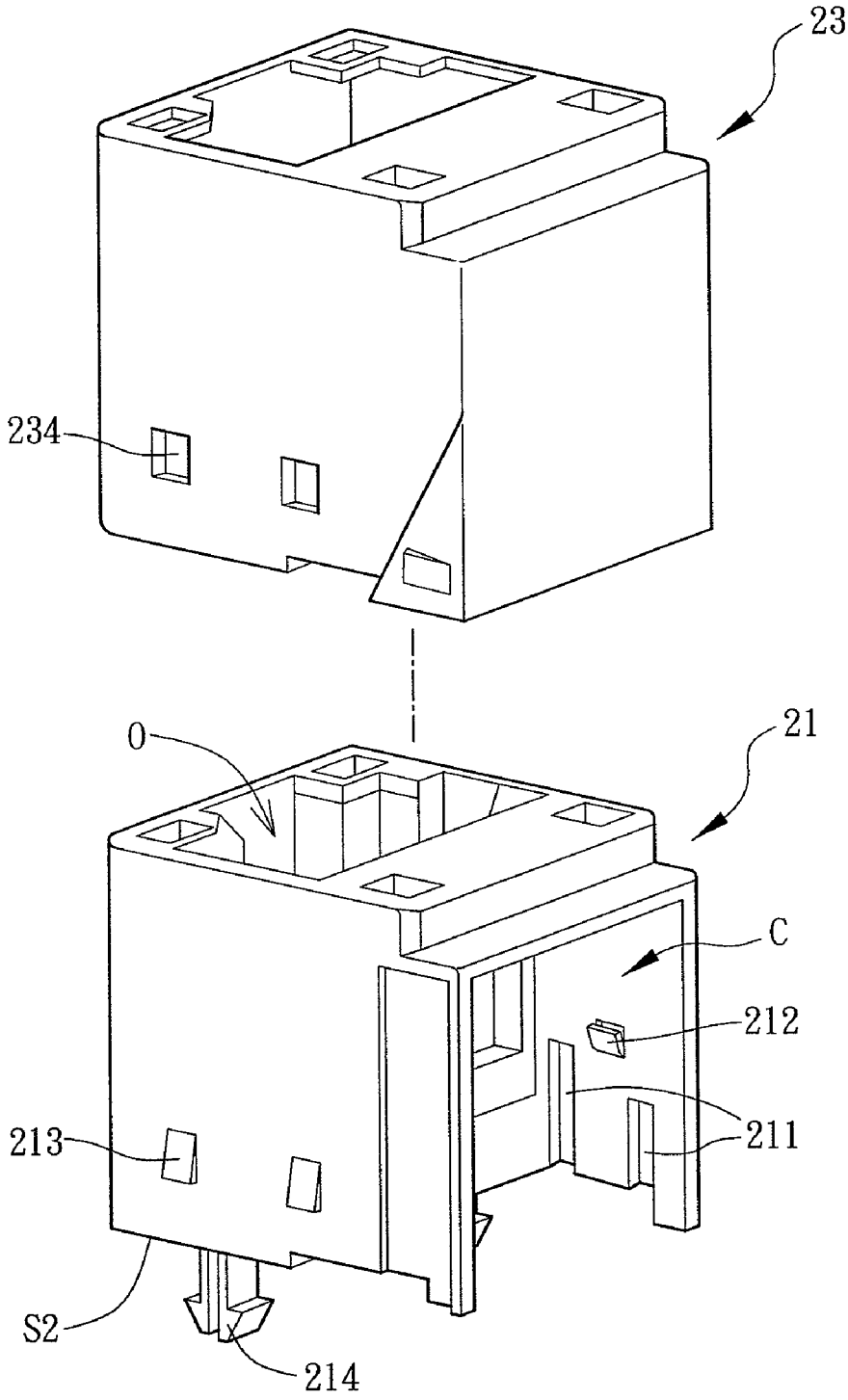
FIG. 3 is a schematic diagram showing a housing and a metal case of the connector according to the embodiment of the present invention.

Referring to FIG. 3, the connector 2 can further include a metal case 23 covering the housing 21. In addition, the housing 21 can further include a first fixing portion 213 disposed at the outer circumference thereof. The metal case 23 further has a second fixing portion 234, which is disposed corresponding to the first fixing portion 213 and located on one side of the metal case 23. Each of the first fixing portion 213 and the second fixing portion 234 can be, for example, a protrusion, a concave, a clasp, a bulk or a groove. The corresponding combination of the first fixing portion 213 and the second fixing portion 234 is similar to that of the first fixing portion 212 and the second fixing portion 222 described above, so the detailed description will be omitted. In the embodiment, the first fixing portion 213 is a bulk and the second fixing portion 234 is a groove for example.

When the metal case 23 covers the housing 21, the second fixing portion 234 and the first fixing portion 213 are fixed with each other. Since the signal transmitted by the signal terminals 223 is easily affected by external transmission lines during transmission, the configuration of the metal case 23 can intensify the noise shielding and benefit the flatness of the bottom S2 of the housing 21, which can facilitate the securely connection between the housing 21 and the circuit board.

When the metal case 23 covers the housing 21, the fourth fixing portion 234 and the third fixing portion 213 are fixed with each other. Since the signal transmitted by the signal terminals 223 is easily affected by external transmission lines during transmission, the configuration of the metal case 23 can intensify the noise shielding and benefit the flatness of the bottom S2 of the housing 21, which can facilitate the securely connection between the housing 21 and the circuit board.

Figure 4:
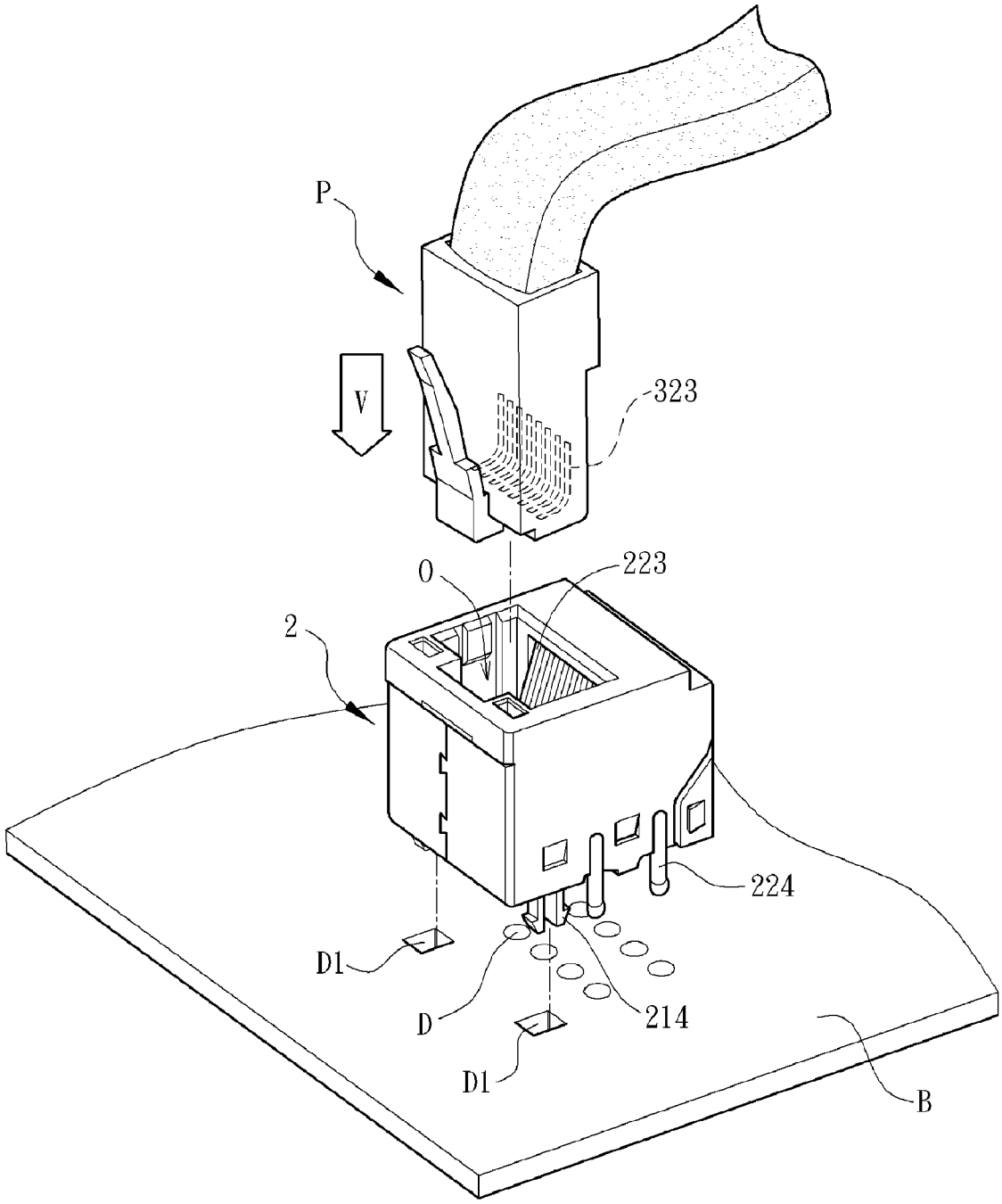
FIG. 4 is a schematic diagram showing the connector according to the embodiment of the present invention that is disposed on a an external circuit board and connected with a plug.
Figure 5:
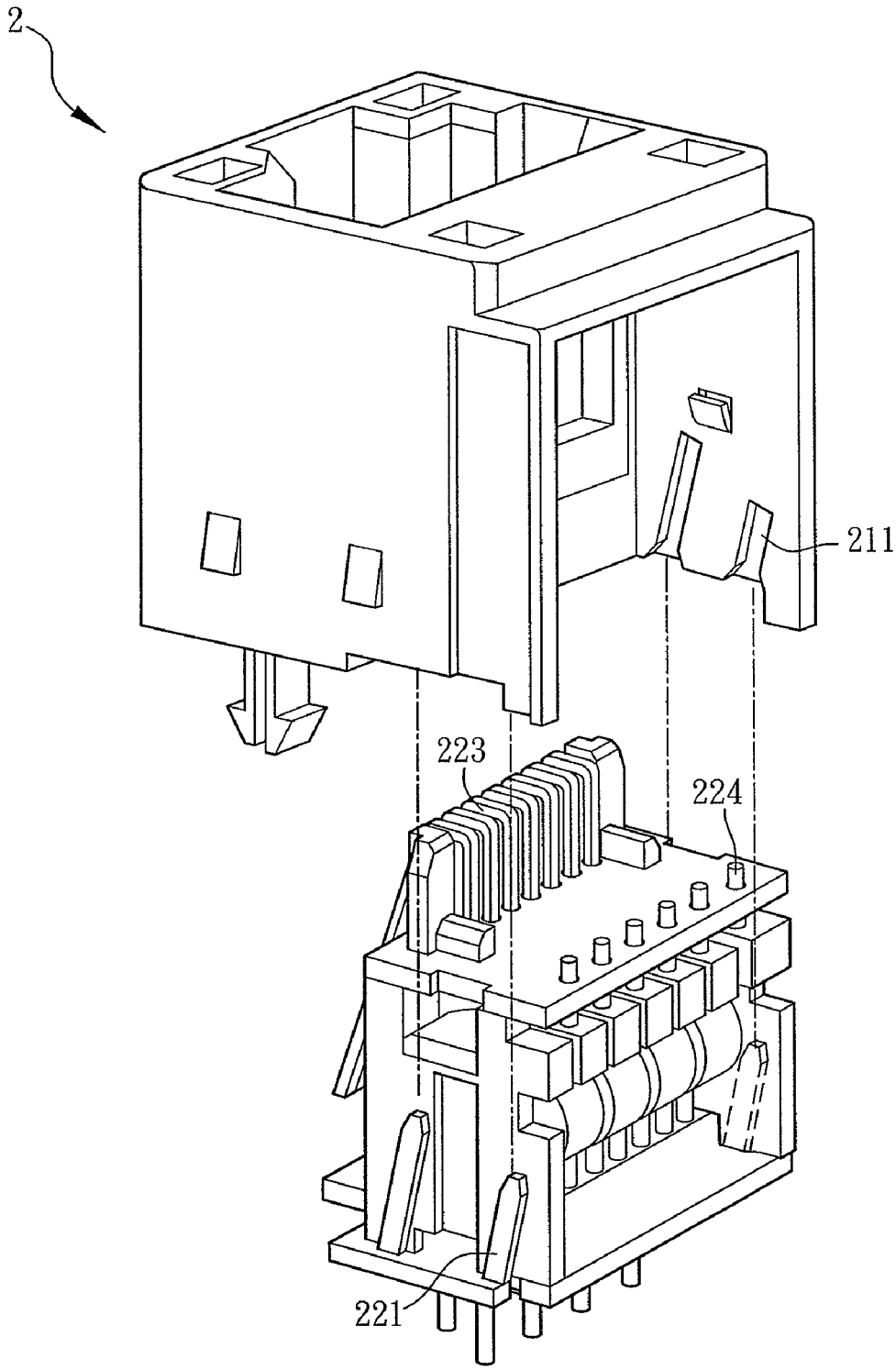
FIG. 5 is a schematic diagram showing a housing and a main body of a connector according to another embodiment of the present invention.

Referring to FIG. 4, after assembling the housing 21, the main body 22 and the metal case 23, the clasps 214 of the housing 21 and the pins 224 of the main body 22 are perpendicular to a circuit board B and respectively inserted into the holes D1 and the holes D. Thus, the connector 2 can be fixed on the circuit board B by the clasps 214 and electrically connected to the circuit board B to transmit signal through the pins 224.

Referring to FIGS. 2 and 4, the main body 22 further has an internal circuit board I for connecting the plurality of signal terminals 223 and the plurality of pins 224. To connect the connector 2 with an RJ-45 plug P, the plug P is inserted into the connector 2 along a vertical direction V, which is perpendicular to the external circuit board B and the internal circuit board I. The signal terminals 223 of the connector 2 are electrically connected with an electrically connecting terminal 323 of the plug P from data outputting and inputting. The electrically connecting terminal of the plug can be a connecting terminal of an RJ-45 plug, an RJ-11 plug or an RJ-12 plug.

In summary, the guiding portion and the fixing portion of the present invention are respectively disposed at the inner circumference of the housing and the outer circumference of the main body, and the arranging directions of the signal terminals and pins can be changed so that the plugging direction of the plug is concordant as the direction of the pins and is perpendicular to the circuit board. Compared with the prior art, a plug can be plugged in the connector of the present invention in a direction perpendicular to the circuit board. Therefore, the present invention can not only change the plugging direction of the plug, but also decrease the layout of the circuit board for the connector so as to improve the circuit layout flexibility. In addition, the present invention also increases the variation of disposing direction of the circuit board in the electronic device, and increases utilization of space design in the electronic device.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A connector connected with an external circuit board, comprising:

a housing having an insert hole and an accommodating portion; and a main body fixed in the accommodating portion and having a plurality of signal terminals, a plurality of pins separated from the signal terminals and an internal circuit board connecting the plurality of signal terminals and the plurality of pins, wherein when a plug is plugged in the insert hole, a plugging direction of the plug is perpendicular to the external circuit board and the internal circuit board.

2. The connector according to claim 1, wherein the housing further comprises at least one first guiding portion and at least one first fixing portion disposed in the accommodating portion.

3. The connector according to claim 2, wherein the main body further comprises at least one second guiding portion and at least one second fixing portion disposed on the main body and located respectively corresponding to the first guiding portion and the first fixing portion.

4. The connector according to claim 3, wherein the first guiding portion is a guiding slot or a guiding track.

5. The connector according to claim 4, wherein when the first guiding portion is the guiding slot, the second guiding portion is correspondingly the guiding track; and when the first guiding portion is the guiding track, the second guiding portion is correspondingly a guiding slot.

6. The connector according to claim 3, wherein the first fixing portion and the second fixing portion are protrusions, concaves, clasps, bulks or grooves.

7. The connector according to claim 1, further comprising a metal case covering the housing.

8. The connector according to claim 7, wherein the housing further comprises a first fixing portion, and the metal case has a second fixing portion disposed corresponding to the first fixing portion.

9. The connector according to claim 8, wherein the first fixing portion and the second fixing portion are protrusions, concaves, clasps, bulks or grooves.

10. The connector according to claim 3, wherein the signal terminals and the pins are disposed in the same direction as the first guiding portion and the second guiding portion.

11. The connector according to claim 3, wherein the signal terminals and the pins are disposed in a direction different from those of the first guiding portion and the second guiding portion.

12. The connector according to claim 1, wherein the housing further comprises at least one clasp at a bottom thereof.

13. The connector according to claim 12, wherein the at least one clasp comprises two hooks reverse from each other.

14. The connector according to claim 1, wherein the connector is an RJ-45 connector, an RJ-11 connector or an RJ-12 connector.

15. The connector according to claim 1, wherein the signal terminals are electrically connected with an electrically connecting terminal of the plug.

16. The connector according to claim 15, wherein the electrically connecting terminal of the plug is a connecting terminal of an RJ-45 plug, an RJ-11 plug or an RJ-12 plug.

* * * * *